US011217055B2

(12) United States Patent
Razzaboni et al.

(10) Patent No.: US 11,217,055 B2
(45) Date of Patent: Jan. 4, 2022

(54) MACHINE FOR DEPOSITING AND DISPENSING COINS

(71) Applicant: CIMA S.p.A., Mirandola (IT)

(72) Inventors: Nicoletta Razzaboni, Mirandola (IT); Vittorio Razzaboni, Mirandola (IT)

(73) Assignee: CIMA S.P.A., Mirandola (IT)

( * ) Notice: Subject to any disclaimer, the term of this patent is extended or adjusted under 35 U.S.C. 154(b) by 259 days.

(21) Appl. No.: 16/524,725

(22) Filed: Jul. 29, 2019

(65) Prior Publication Data

US 2020/0035055 A1 Jan. 30, 2020

(30) Foreign Application Priority Data

Jul. 30, 2018 (IT) ..... 102018000007620
Nov. 28, 2018 (IT) ..... 102018000010640

(51) Int. Cl.
*G07D 3/00* (2006.01)
*G07D 1/00* (2006.01)

(52) U.S. Cl.
CPC ..... *G07D 3/00* (2013.01); *G07D 1/00* (2013.01)

(58) Field of Classification Search
CPC ..... G07D 3/00; G07D 1/00
See application file for complete search history.

(56) References Cited

U.S. PATENT DOCUMENTS 5,056,643 A 10/1991 Kirberg
5,938,072 A * 8/1999 Lamoureux ..... G07D 1/00 221/253
7,625,272 B1 12/2009 Moreland
8,141,772 B1 * 3/2012 Folk ..... G06Q 20/203 235/379

(Continued)

FOREIGN PATENT DOCUMENTS

EP 2690604 A1 1/2014
GB 2326507 A 12/1998
WO 2007035420 A2 9/2006

*Primary Examiner* — Thien M Le
*Assistant Examiner* — Asifa Habib
(74) *Attorney, Agent, or Firm* — Cantor Colburn LLP

(57) ABSTRACT

A machine for depositing and dispensing coins includes a first portion containing devices for reception of the deposited coins and for recognition and sorting of the coins based on the denomination thereof, a second portion containing a plurality of internal hoppers configured to selectively contain the coins sorted by denomination and a third portion containing coin processing means for processing the coins in the dispensing step, a seat being present in the third portion for the temporary housing of a till configured to be filled with predetermined compositions of coins of the various denominations coming from the internal hoppers, the machine further including coin conveying means adapted to receive, at the seat, coins coming from the internal hoppers or from the recognition and sorting devices and to convey them to a higher zone of the machine, where a coin path selector is disposed at the end of the coin conveying means (Continued)

to the higher zone of the machine, the coin path selector being movable between a first position where it enables the conveyance of the coins into an internal collection container and a second position where it enables the dispensing of the coins outside the machine.

22 Claims, 9 Drawing Sheets

(56) References Cited

U.S. PATENT DOCUMENTS

| | | | | |
|---|---|---|---|---|
| 8,936,505 | B2 * | 1/2015 | Bengtsson | G07D 9/008 453/18 |
| 2008/0085671 | A1 * | 4/2008 | Nishida | G07D 3/14 453/57 |
| 2009/0047888 | A1 * | 2/2009 | Nishida | G07D 9/008 453/3 |
| 2010/0017017 | A1 * | 1/2010 | Adams | G07D 9/02 700/223 |
| 2013/0178139 | A1 * | 7/2013 | Hallowell | G06K 5/00 453/15 |
| 2016/0379432 | A1 | 12/2016 | Lavigne | |
| 2017/0224134 | A1 | 8/2017 | Watanabe | |

* cited by examiner

MACHINE FOR DEPOSITING AND DISPENSING COINS

CROSS REFERENCE TO RELATED APPLICATIONS

This application is related to and claims the benefit of Italian Patent Application No. 102018000007620 filed on Jul. 30, 2018 and Italian Patent Application No. 102018000010640 filed on Nov. 28, 2018, the entire contents of which are incorporated herein by reference in their entirety.

TECHNICAL FIELD

The present disclosure refers to a machine for managing coins, in particular adapted to receive and dispense coins, tokens or similar.

BACKGROUND

In the prior art machines capable of receiving and storing valuables inside them, for example coins, deposited by an operator are used. These machines, usually called "coin deposit machines", are generally provided with a portion for accepting the coins introduced by the user, a system for recognizing and sorting the coins based on their denomination and a plurality of internal hoppers for containing the coins sorted by denomination.

A typical example of use of these machines is in the commercial concerns, where the cashiers empty their till at the end of their shift, depositing the coins into the machine through a suitable inlet opening, which conveys them to the recognition and sorting system and then to the respective hoppers depending on the denomination of each coin.

These machines have the drawback that the deposited coins must then be removed from the respective internal hoppers, taken into the custody of workers authorized and trained in the transportation of valuables (CIT, or Cash-In-Transit) and finally managed in suitable ways for subsequent use at other locations.

Machines adapted to dispense coins, called "coin dispensing machines" are also used, in which there are internal hoppers dedicated to the various denominations, properly filled by authorized workers with the appropriate amounts of coins of each denomination, and means for dispensing coins in the amount required by the user, in single denominations or as a specific composition of various denominations. A typical example of use of these dispensing machines is for selectively filling the tills of cashiers at the start of shift, with each denomination introduced into the respective dedicated space of the till.

Also in these machines the main drawback is that the internal hoppers must be regularly refilled with coins of the various denominations by workers specialized in the transportation of valuables.

Finally, there are machines that combine the functionalities of depositing and dispensing coins, called "coin recycling machines", which are provided with a portion for accepting the coins introduced by the user, a system for recognizing and sorting the coins based on their denomination, a plurality of internal hoppers for containing the coins sorted by denomination and means for dispensing the coins from the hoppers to the user in the required amount. Of course, these machines must also have an accounting system of the coins deposited and of the coins dispensed, so as to keep track of all the operations carried out and always have the complete outline of the content of each single hopper.

In these machines it may be the case that, during the depositing step, more coins, of one or more denominations, are introduced than the respective internal hoppers can receive based on their content prior to the start of the depositing step.

In this case, it could in theory be necessary to suspend the depositing operation. Some machines, however, provide for the possibility of sending the excess coins (of the denominations for which the hoppers are unable to receive the total amount arriving) into a suitable container (overflow container) generally positioned at the bottom of the machine below the internal hoppers. The sending of the excess coins to such a container can take place either by making the just introduced and verified coins by-pass the hoppers, or by unloading a suitable number of coins from the respective hoppers directly into the overflow container, so as to free space inside them for the new coins.

It is clear, in any case, that coins of every denomination, mixed together, are eventually collected in the overflow container. This implies the need to take care of periodically emptying the container or removing and replacing it with an empty container, operations that should generally be entrusted to authorized workers for managing and transporting valuables (CIT), since the content of such a container (i.e. coins of various denominations mixed together) cannot be managed and reused without a suitable accounting and sorting procedure of the single denominations.

In particular, if after a certain number of withdrawals (without sufficient deposits occurring in the meantime) one or more hoppers end up in the condition of containing an insufficient number of coins of the respective denominations to deal with further dispensing requests, the coins present in the overflow container obviously could not be used directly to restore the level of the hoppers (because, as stated, it contains various denominations mixed together), but it would on the other hand be necessary to acquire from the outside (typically from CIT) suitable stocks of coins of homogeneous denomination to restock the corresponding hopper, with relative waits and additional costs.

An example of use of "recycling machines" is also described in application US 2016/0379432, where it is provided that, in order to allow people with disabilities to withdraw coins at a height convenient for them, a mode of operation can be selected that, instead of unloading the coins from the hoppers into the dedicated spaces of the till, selectively divided by denomination, makes them flow to an elevator that drives the coins to a dispensing mouth arranged at a suitable height, but dispensing them to the user mixed together without distinction of denomination.

BRIEF SUMMARY

The general purpose of the present disclosure is to avoid the aforementioned drawbacks by supplying a machine for depositing and dispensing coins that makes it possible to simplify the management of the coins during the depositing and dispensing steps and to optimize the content of its internal hoppers.

A further purpose of the disclosure is to avoid possible situations that can lead to the shutdown of the machine due to a lack or excess of coins of a certain denomination.

In particular, a purpose of the disclosure is to make it possible to manage the excess coins in the hoppers both as a mix of coins of various denominations collected in a single container, and as quantities of coins divided by denomination, which can be advantageously stored securely at the same manager of the machine and used when necessary to restore the level of coins in specific hoppers, for example at the moments of maximum demand for dispensing by cashiers.

In view of such purposes, it has been thought of to make, according to the disclosure, a machine for depositing and dispensing coins, comprising a first portion containing devices for reception of the deposited coins and for recognition and sorting of the coins based on the denomination thereof, a second portion containing a plurality of internal hoppers intended to selectively contain the coins sorted by denomination and adapted to form a reserve for dispensing predetermined amounts and compositions of coins, and a third portion containing coin processing means for processing the coins in the dispensing step, said third portion being arranged at a lower height with respect to the second portion, a seat being present in said third portion for the temporary housing of a till used by a user, intended to be filled with predetermined compositions of coins of the various denominations coming from the internal hoppers, the machine also comprising coin conveying means adapted to receive, at the seat for the temporary housing of a till, at a height equal to or lower than it, coins coming from the internal hoppers or from the coin recognition and sorting devices, alternatively to the dispensing in the till, and to convey them to a higher zone of the machine, characterized in that a coin path selector is arranged at the end of said coin conveying means to said higher zone of the machine, the coin path selector being movable between a first position wherein it enables the conveyance of the coins into an internal collection container and a second position wherein it enables the dispensing of the coins outside the machine.

According to the disclosure, a method for using this machine for depositing and dispensing coins has also been made, wherein coins coming from the internal hoppers or from the coin recognition and sorting devices are conveyed, by means of said coin conveying means adapted to receive the coins at the seat for the temporary housing of a till, up to a coin path selector in said higher zone of the machine, characterized in that the coin path selector is alternatively positioned either in a first position adapted to convey the coins into said internal collection container or in a second position adapted to dispense the coins outside the machine.

BRIEF DESCRIPTION OF THE DRAWINGS

In order to make the explanation of the innovative principles of the present disclosure and its advantages with respect to the prior art clearer, a possible example embodiment applying such principles will be described hereinafter, with the help of the attached drawings. In the drawings.

DETAILED DESCRIPTION

Figure 1:
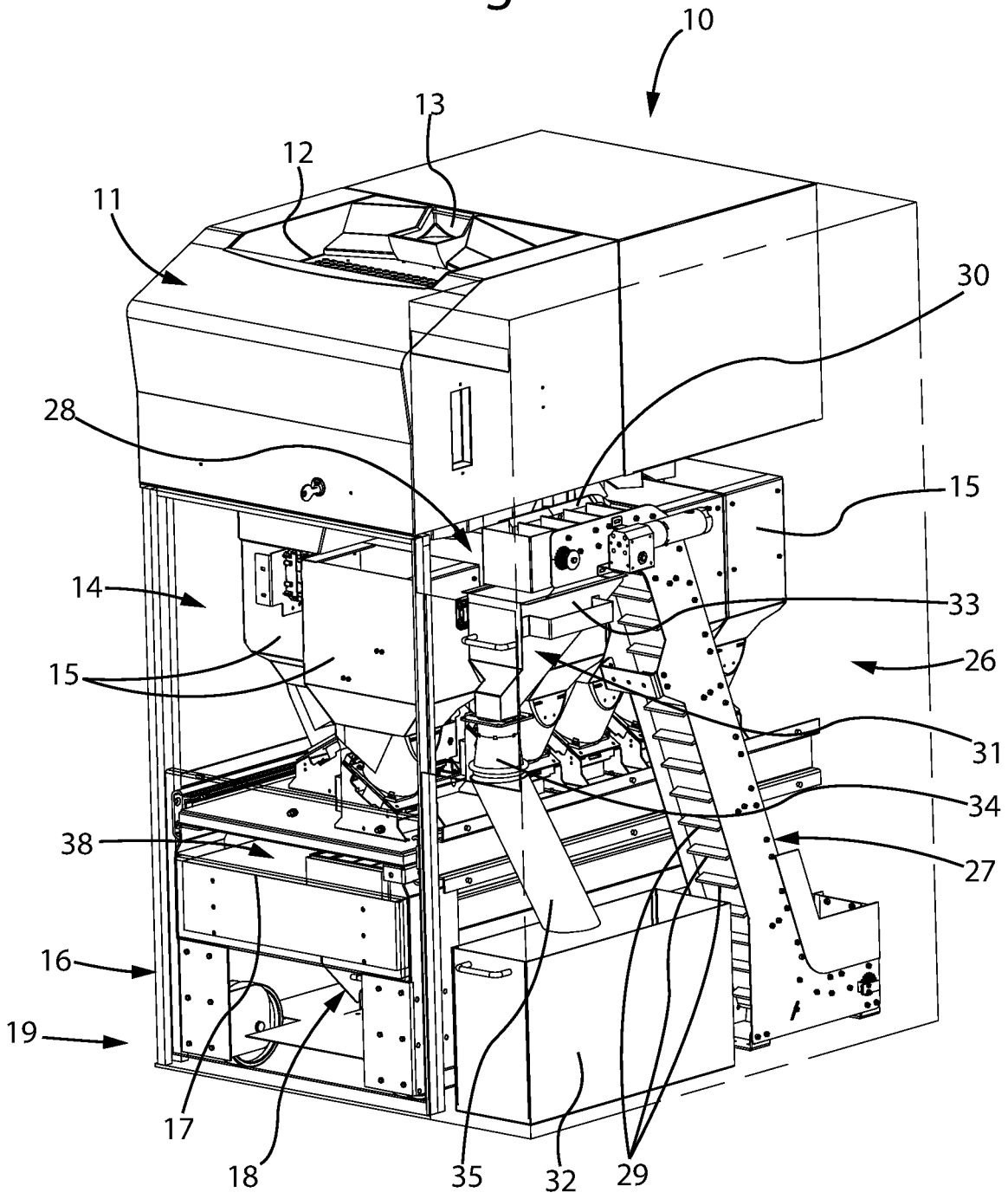
FIG. 1 represents a perspective view of a machine for depositing and dispensing coins according to the disclosure.
Figure 2:
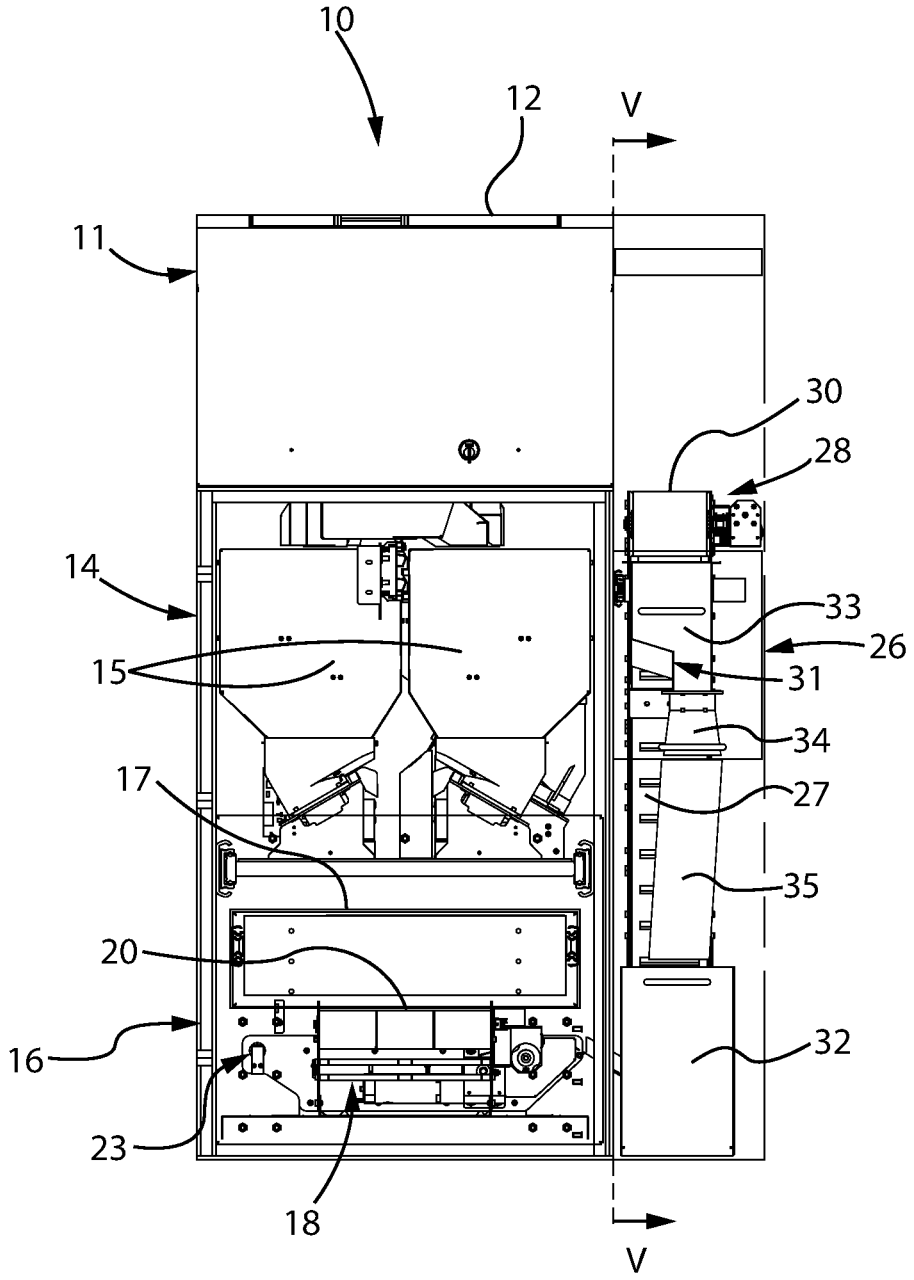
FIG. 2 represents a front view of the machine of FIG. 1.
Figure 3:
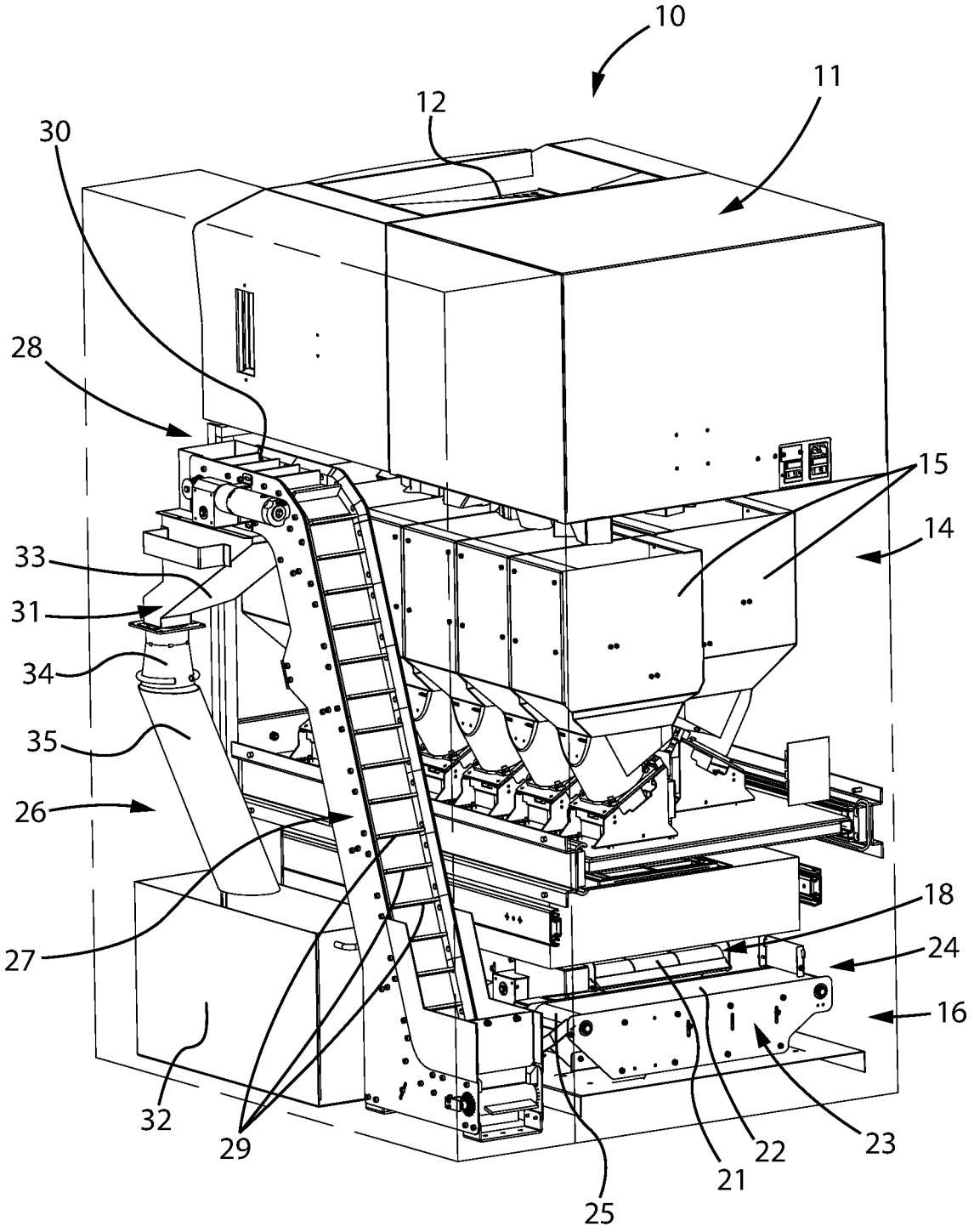
FIG. 3 represents a perspective view of the rear part of the machine of FIG. 1.
Figure 4:
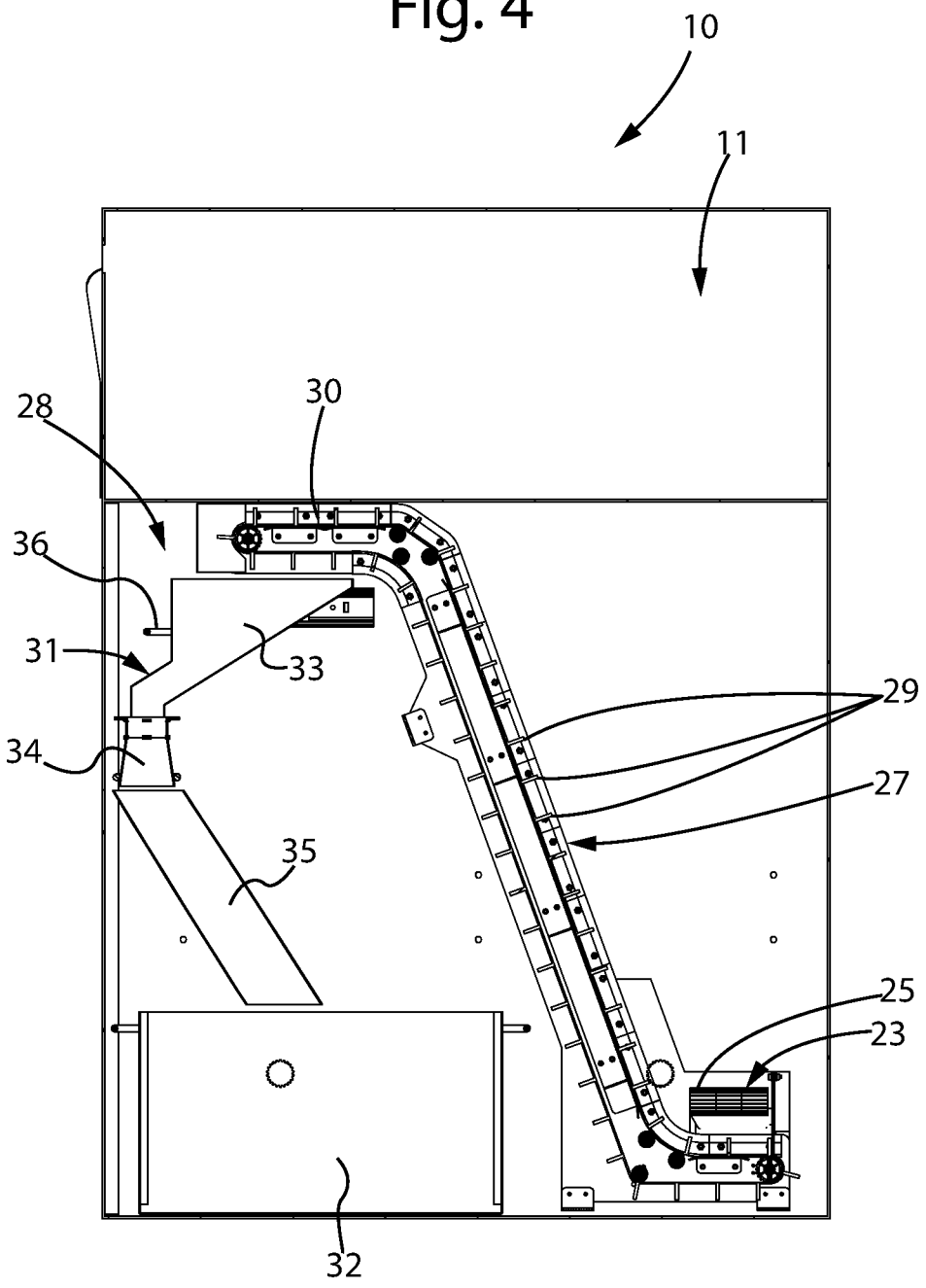
FIG. 4 represents a side view of the machine of FIG. 1.

With reference to the figures, FIG. 1 illustrates a machine 10 for depositing and dispensing coins according to the disclosure.

The machine 10 generically comprises a first upper portion 11 in which there is a tray 12 for receiving the coins deposited by the user (typically a cashier at end of shift, who must empty his/her own till) and an opening 13 for introducing coins inside the machine. Advantageously, the tray 12 is liftable and tiltable so as to make the coins contained in it flow directly towards the introduction opening 13.

Inside the upper portion 11 of the machine there are also (not shown in detail in the figures, since they are devices well known to those skilled in the art) means for recognizing and verifying the coins and for sorting them based on denomination.

With the exception of said first upper portion 11, in the attached figures the machine is in general graphically represented with the outer walls partially "transparent" to make it possible to see internal components that perform a structurally and functionally significant role in the present disclosure.

The machine 10 also comprises a second intermediate portion 14, wherein the internal hoppers 15 intended to selectively contain the coins sorted by denomination and adapted to form a reserve for dispensing predetermined amounts and compositions of coins are located, and a third lower portion 16 wherein means are present for processing the coins in the dispensing step, as will be described in more detail hereinafter.

This third portion 16 is at a lower height with respect to the intermediate portion 14, advantageously below it.

In particular, a seat 17 is present in this third lower portion 16, said seat being for the temporary housing of a till, not shown in the figures, adapted to be selectively filled, during the dispensing step, with the coins coming from the internal hoppers 15.

Typically, the till can be a container for use by cashiers of commercial concerns, provided with a plurality of spaces corresponding to the single denominations of coins in use. For the correct operation of this type of machine, each space of the till corresponds to a specific internal hopper 15 so that each hopper unloads coins of a certain denomination into a corresponding space of the till creating a reserve of coins for the cashier, separated by denomination.

In use, the cashier at the start of shift inserts his/her own empty till into the seat 17, through a suitable opening in the wall of the machine, so that it is filled with a predetermined amount of coins of the various denominations coming from the internal hoppers 15, so as to have a composition of coins available to carry out transactions with customers (payments, giving change, etc.). Once the dispensing of the coins has been carried out by the internal hoppers 15, the cashier then extracts his/her till from the seat 17.

At end of shift, on the other hand, the cashier can deposit the contents of his/her till by pouring the coins into the collection tray 12 in the upper part of the machine, so that they can be received, verified and selected by denomination by the machine itself and, in normal conditions, stored in the respective internal hoppers 15.

In the third lower portion 16 there is also, at the same or lower height with respect to the seat 17 for the till, a first conveyor 18 adapted to receive coins coming from the internal hoppers 15 alternatively to the dispensing in the till, or also directly from the coin recognition and sorting devices present in the upper portion 11 of the machine, and to convey them in a first direction 19 from a loading zone 20 thereof towards a side of the machine up to an unloading end 21 thereof. Advantageously, such a side of the machine towards which this first conveyor 18 is directed is the rear side when the front side is considered to be that through which the till is introduced into the seat 17 by the operator. Of course, other arrangements of the parts can be foreseen depending on particular constructive and bulk requirements of the machine.

According to a preferred embodiment of the machine according to the present disclosure, the first conveyor 18 is formed of a motorized endless conveyor belt. However, it could also be made by means of an inclined plane, exploiting gravity for the movement of the coins from the loading zone 20 to the unloading end 21.

Advantageously, the loading zone 20 of the first conveyor 18 is positioned immediately below the seat 17 for the till and said seat 17 is provided with a vertical passage opening 38, so as to allow the coins dispensed by the internal hoppers 15 to fall directly on the conveyor 18, instead of in the till, when a till is not present in the seat 17.

At the unloading end 21 of the first conveyor 18, advantageously at a slightly lower height, there is the loading zone 22 of a second conveyor 23 for the transfer of the coins in a second direction 24 up to an unloading end 25 thereof at a side portion 26 of the machine. The term side portion of the machine here is meant to indicate a zone arranged laterally with respect to the internal hoppers 15 and to the seat 17 for the till. However, advantageously, said side portion 26 can also be a suitable module, beside the outer wall of the machine, as can be seen from the attached figures.

According to a preferred embodiment of the machine according to the present disclosure, the second conveyor 23 is also formed of a motorized endless conveyor belt. However, it could also be made by means of an inclined plane, exploiting gravity for the movement of the coins from the loading zone 22 to the unloading end 25.

In the illustrated embodiment, the direction 24 according to which the second conveyor belt 23 moves is advantageously perpendicular to the direction 19 according to which the first conveyor belt 18 moves.

A third conveyor 27 is arranged at the unloading end 25 of the second conveyor 23, said third conveyor being adapted to receive the coins from the second conveyor 23 and to drive them to a higher zone 28 of the machine, advantageously again at the side portion 26 thereof.

The first conveyor 18, the second conveyor 23 and the third conveyor 27 overall constitute coin conveying means from the zone below the seat 17 for the till to a higher zone of the machine where dispensing of the coins to the outside or collection thereof in a container inside the machine can be selected.

In particular, the first conveyor 18 and the second conveyor 23 in combination constitute lateral transfer devices of the coins from the zone of the seat 17 for the temporary housing of a till to the aforementioned side portion 26 of the machine, where here the term lateral transfer is meant to indicate a substantially horizontal overall movement, i.e. substantially at the same height as the zone where the coins are received on said transfer devices through the vertical passage opening 38 in the seat 17 for the temporary housing of a till.

The third conveyor 27, on the other hand, constitutes an elevator for transferring the coins from said lower height up to the higher zone 28 of the machine.

According to a preferred embodiment of the machine according to the present disclosure, the third conveyor 27 is formed of a motorized endless conveyor belt, provided with blades 29 for supporting the coins during the transfer from the lower height to the higher zone 28 of the machine.

At the upper end 30 of the elevator 27 there is a selector 31 adapted to receive the coins coming from the aforementioned conveying means 18, 23, 27 and to direct them alternatively towards a collection container 32 housed inside the machine, or towards the outside of the machine.

The selector 31 is advantageously formed of an upper funnel portion 33, adapted to collect the coins coming from the elevator 27, and of a lower collector portion 34 intended for dispensing the coins.

Figure 5:
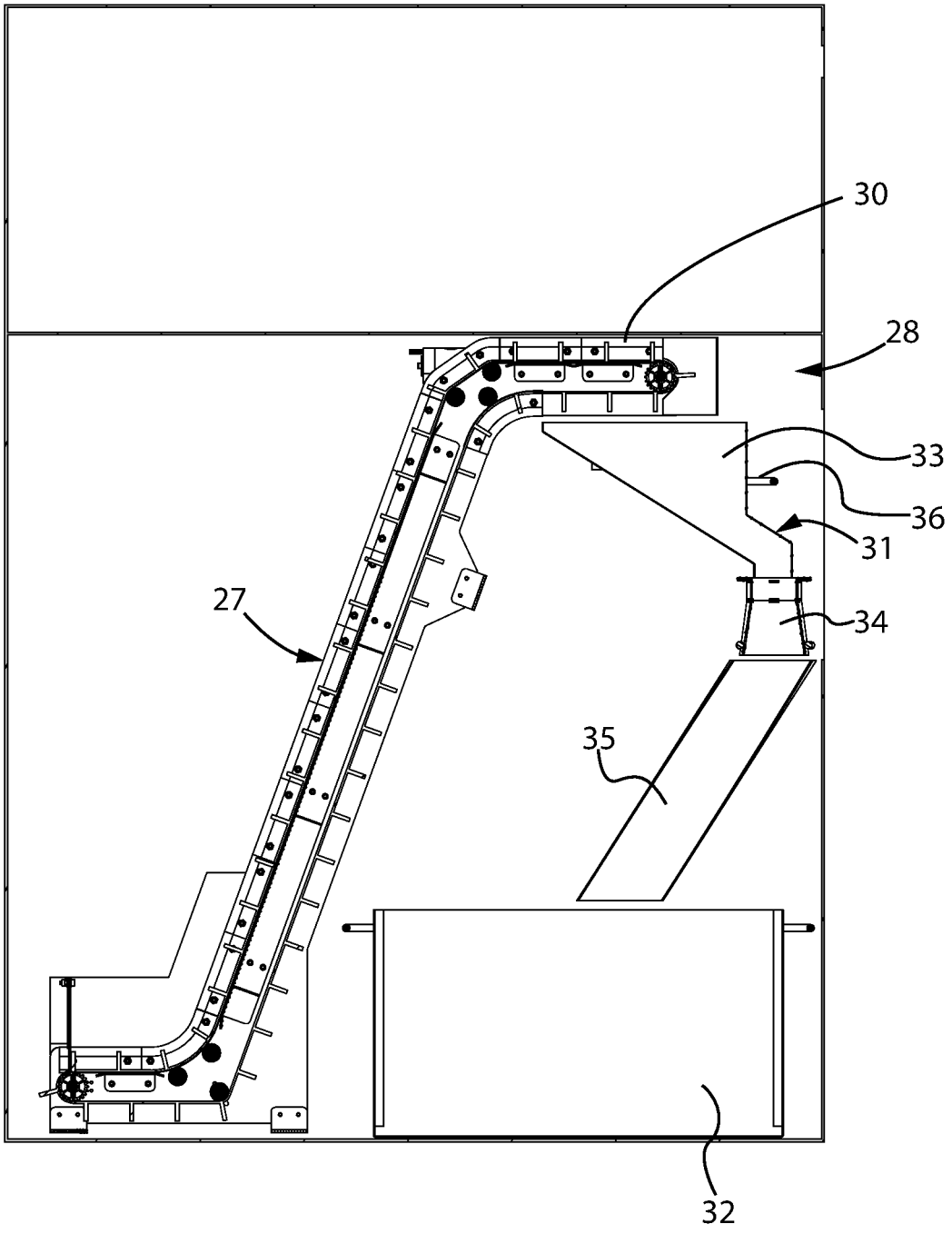
FIG. 5 represents a view of the machine according to the section V-V of FIG. 2, in a first operative condition according to the disclosure.

The selector group 31 is movable between a first position retracted towards the inside of the machine (illustrated in FIG. 5), wherein the collector 34 is located at the mouth of a conduit 35 directed towards the aforementioned collection container 32 housed inside the machine, and a second position advanced towards the outside of the machine (illustrated in FIG. 6), wherein the collector 34 faces outside of the machine.

The selector group 31 can be maneuvered manually by the operator between the two operative positions thereof, for example by acting on a suitable handle 36, even though a motorization thereof can be provided in the case in which it is wished to subordinate the selection of the two dispensing modes to an automated and centralized management.

The upper funnel portion 33 has inlet opening of sufficient size to collect the coins coming from the elevator 27 both when the selector 31 is in the retracted position, and when it is in the advanced position.

Advantageously, the collector 34 is configured so as to provide support and fastening for a bag 37 (or other similar container) in which to collect the coins dispensed to the outside. Of course, suitable means can be provided to prevent the selector group 31 from moving from the advanced position to the retracted position if a bag is present on the collector 34.

FIGS. 7-10 illustrate a variant embodiment of the coin path selector towards the collection container housed inside the machine, or towards the outside of the machine, applied to a machine otherwise totally analogous to that illustrated in FIGS. 1-6.

The machine illustrated in FIGS. 7-10 thus comprises a first upper portion 11 containing means (such as the collection tray 12 and the introduction opening 13) for receiving the deposited coins and devices for recognizing and sorting the coins themselves based on their denomination, a second intermediate portion 14, wherein the internal hoppers intended to selectively contain the coins sorted by denomination and adapted to form a reserve for dispensing predetermined amounts and compositions of coins are located, and a third lower portion 16 wherein means are present for processing the coins in the dispensing step.

The hoppers 15 and the seat 17 for the temporary housing of the till are not visible in FIGS. 7-10 since they are concealed by the outer or dividing walls of the machine, however they are totally analogous to the corresponding devices illustrated in FIGS. 1-6.

The machine illustrated in FIGS. 7-10 also comprises lateral transfer means of the coins from the zone of the seat 17 for the temporary housing of the till to the side portion 26 of the machine (formed of a first conveyor 18 and a second conveyor 23 totally analogous to those shown in the machine represented in FIGS. 1-6) and an elevator 27 (also totally analogous to that shown in the machine illustrated in FIGS. 1-6) for transferring the coins to the higher zone 28 of the machine where dispensing of the coins to the outside or into a container inside the machine can be selected.

At the upper end 30 of the elevator 27 there is a selector 131 adapted to receive the coins coming from the conveying means 18, 23, 27 and to direct them alternatively towards a collection container 32 housed inside the machine, or towards the outside of the machine.

Figure 7:
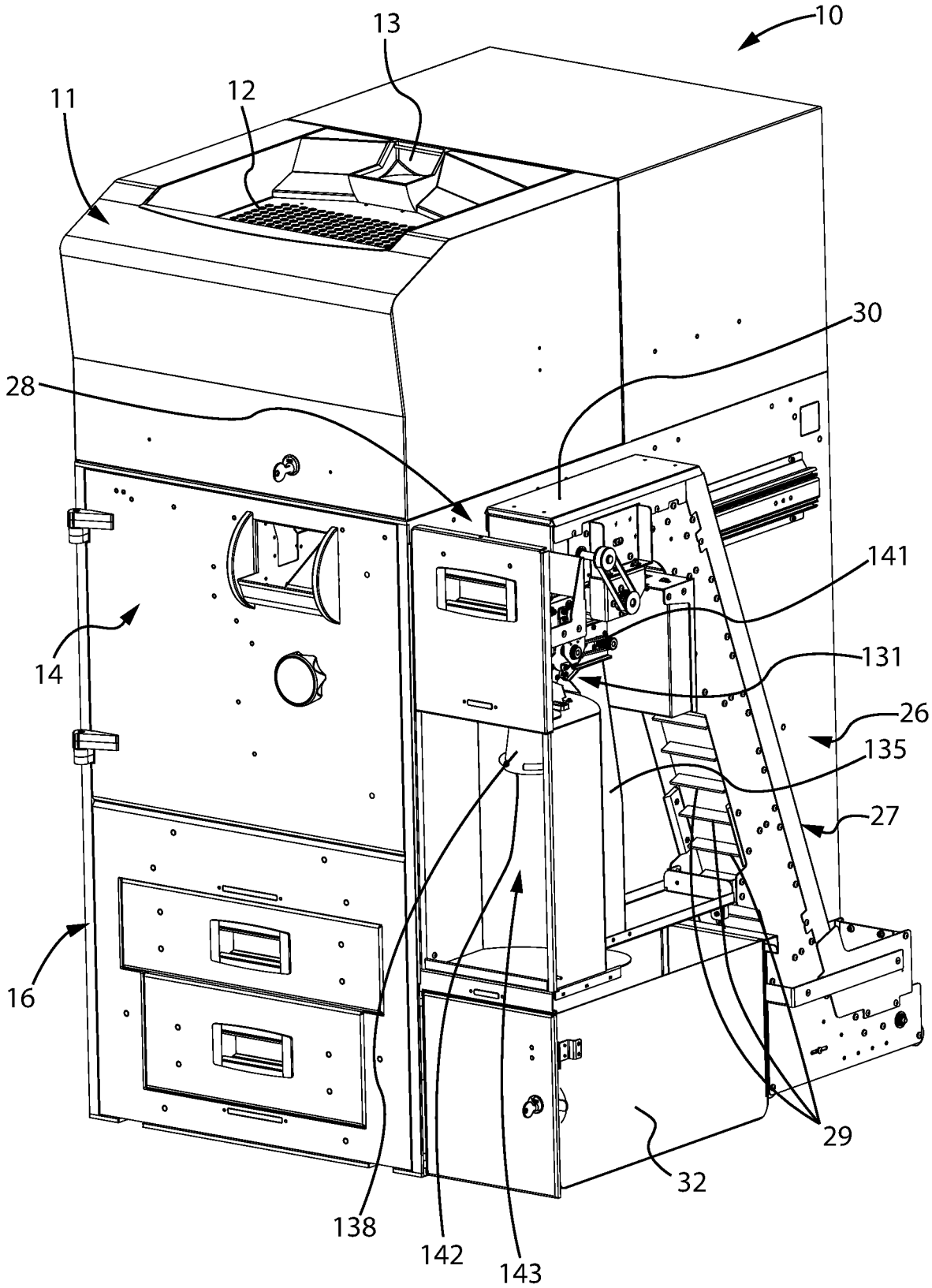
FIG. 7 represents a perspective view (similar to that of FIG. 1) of a machine for depositing and dispensing coins according to a variant embodiment of the present disclosure.
Figure 8:
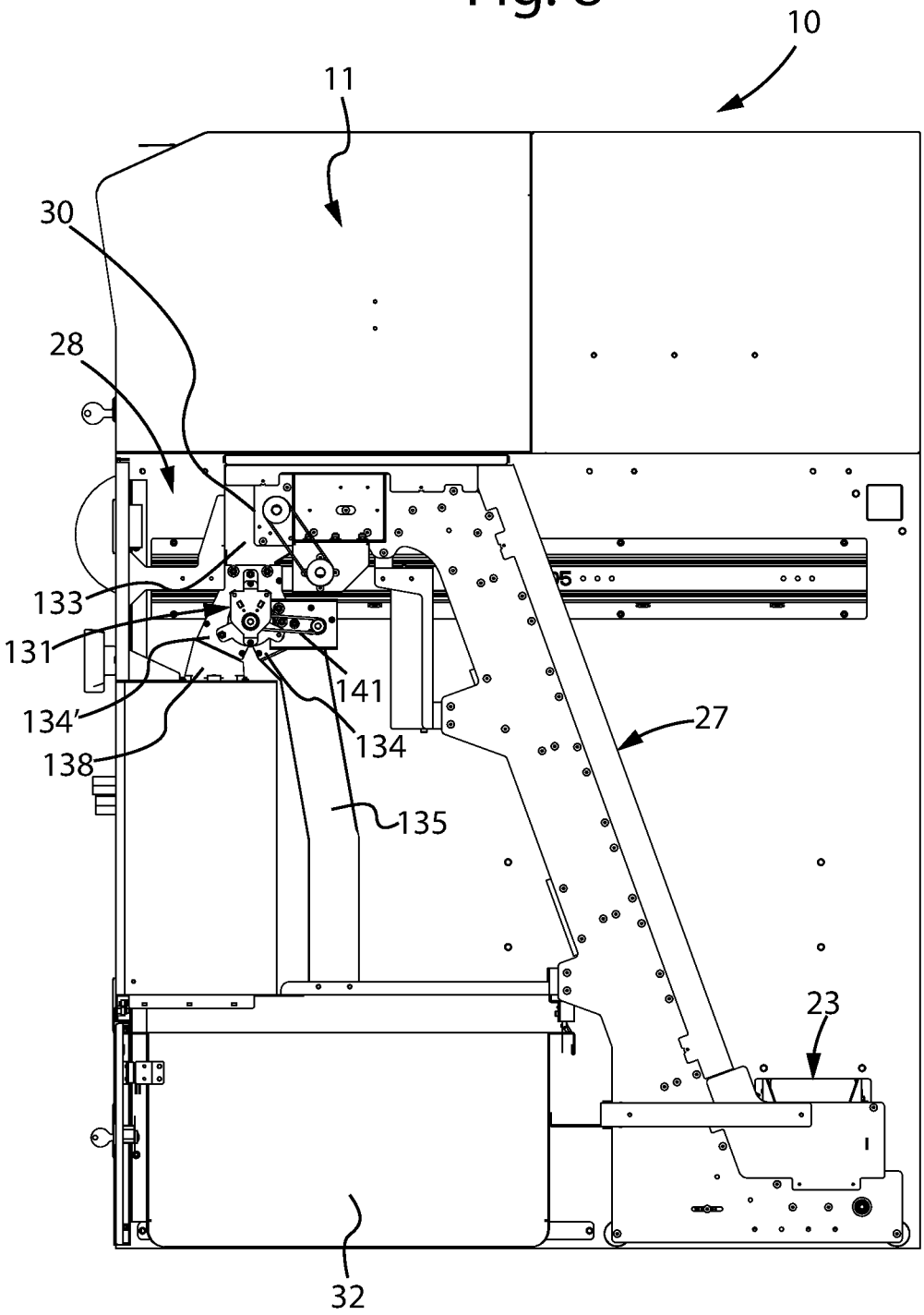
FIG. 8 represents a side view of the machine of FIG. 7.

In the variant embodiment illustrated in FIGS. 7-10, the selector 131 is formed (as can be seen in FIG. 8 and, even better, in the enlarged views of FIG. 9 and FIG. 10) of an upper portion 133, adapted to collect the coins coming from the elevator 27, and of two lower collector portions 134, 134' intended respectively to convey the coins towards the internal collection container 32 or towards the outside of the machine, in a suitable bag 37.

Figure 9:
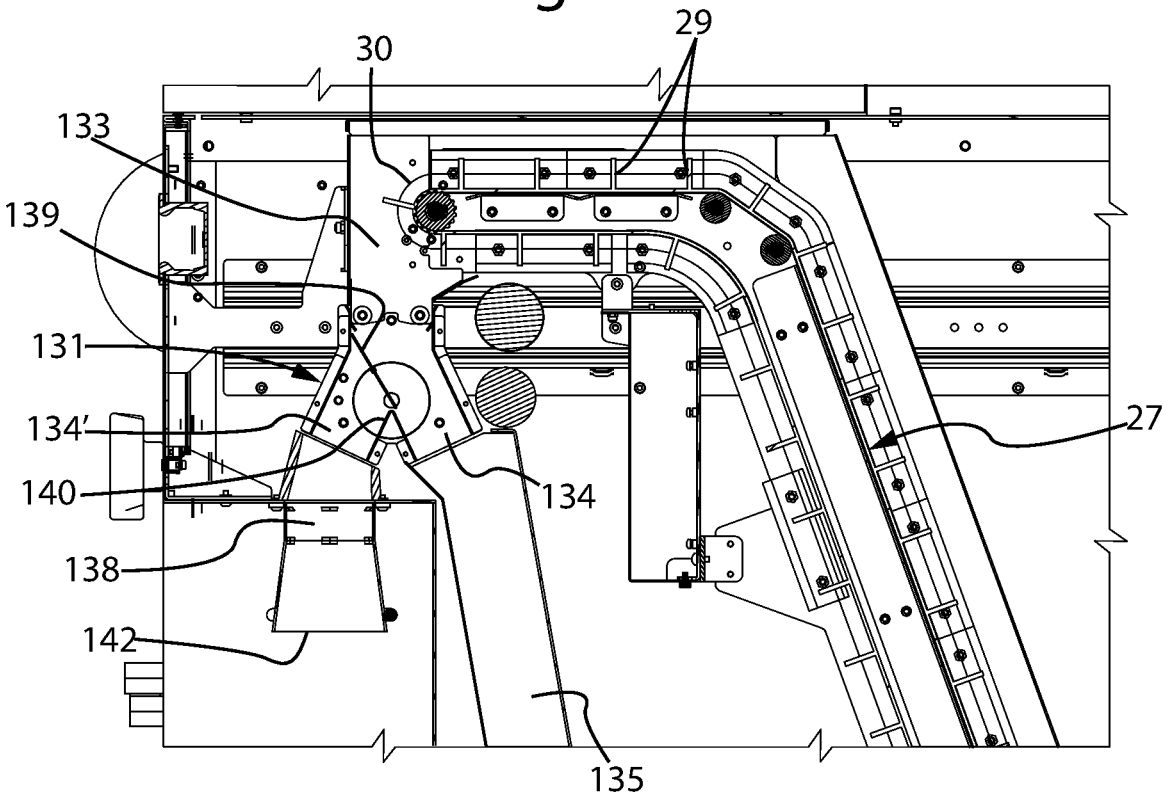
FIG. 9 represents a section view of the coin path selector, according to the variant embodiment of FIG. 7, in the first operative condition according to the disclosure.

As can be clearly seen in FIGS. 9 and 10, the selector 131 is arranged between the upper end 30 of the elevator 27 (where the upper collection portion 133 receives the falling coins dragged by the blades 29 of the elevator 27) and two conduits 135, 138 arranged below the selector and directed respectively towards the aforementioned collection container 32 housed inside the machine and towards the outside of the machine for dispensing the coins in a bag 37 (or other similar container). In particular, the first lower collector portion 134 of the selector 131 is arranged at the mouth of said conduit 135 directed to the internal collection container 32, whereas the second lower collector portion 134' is arranged at the mouth of said conduit 138 directed towards the outside of the machine.

The selector 131 is provided with a diverting fin 139 that is movable between a first position (represented in FIG. 9), wherein the fin closes the access to the second lower collector portion 134' and to the conduit 138 towards the outside of the machine and opens the access to the first lower collector portion 134 and to the conduit 135 towards the internal collection container 32, and a second position (represented in FIG. 10), wherein vice-versa the fin closes the access to the first lower collector portion 134 and to the conduit 135 towards the internal collection container 32 and opens the access to the second lower collector portion 134' and to the conduit 138 towards the outside of the machine.

The diverting fin 139 is advantageously hinged, at an end thereof, at the vertex 140 of the forking between the two lower collector portions 134, 134'.

In the embodiment illustrated here, the diverting fin 139 can be actuated by means of a belt actuator 141, visible in FIG. 8. Of course, other modes of actuation of the diverting fin 139 can be provided, such as a toothed wheel transmission, a motor fitted directly on the pin, etc., or with an actuation by solenoid.

The actuation of the diverting fin 139 can for example take place in response to a selection command, by the user, of the dispensing mode required for the coins.

The end 142 of the conduit 138 for dispensing the coins outside of the machine is configured so as to provide support and fastening for a bag 37 (or other similar container) in which to collect the coins dispensed outside and, as can be seen in FIG. 7, said end 142 faces into a niche 143 contained inside the external shape of the machine, so as to reduce the total bulk of the machine itself.

The advantage of dispensing coins externally into a bag, alternatively to dispensing into the collection container 32 housed inside the machine, is that the bag is generally of lower weight and smaller size with respect to said internal container 32 and, therefore, it can be easily managed so as to be filled on each occasion with a single denomination of coins (thus obtaining a homogeneous and defined content), removed and stored directly by the manager of the machine, without intervention of workers specialized in the management and transportation of valuables. Indeed, it should be considered that the collection container 32 is arranged inside the machine and is thus accessible only through the opening of suitable locks, whose keys are not normally available to the usual users of the machine (for example the cashiers of a commercial concern).

In this way it is for example possible to have a reserve of coins consisting of a plurality of single bags, each containing a certain denomination, able to be used to restore the optimal level of the content of one or more internal hoppers 15 that might be in the condition of containing an insufficient number of coins of the respective denominations to deal with further dispensing requests, for example at busy times at the cash.

It is clear from the description given above how the selector group 31 (movable upon command between its retracted position and its advanced position) or 131 (with the diverting fin 139 rotatable upon command between the closed positions of the conduit towards the internal container 32 or of the conduit towards the outside) is capable of selectively enabling the dispensing of the coins outside the machine or the storing thereof inside the machine itself, depending on the operative modes selected by the manager of the machine.

Some aspects of the operation of the machine according to the innovative features of the present disclosure will be described briefly here.

In the coins depositing step, if an internal hopper 15 exceeds its predetermined capacity level, the excess coins of the corresponding denomination (verified and selected by denomination by the suitable devices present in the upper portion 11 of the machine) can be led directly to the lateral transfer conveyors 18, 23 or, alternatively, an appropriate amount of coins of the denomination concerned can be made to come out from the aforementioned internal hopper 15, passing through the vertical passage 38 of the seat 17 for the till (which is not present in the depositing step) up to the loading zone 20 of the first conveyor 18, so as to free space inside such hopper for the new arriving coins of that denomination.

In any case, the coins that have thus reached the lateral transfer conveyors 18, 23 are made to flow to the elevator 27 that transfers them to the aforementioned higher zone 28 of the machine.

Figure 6:
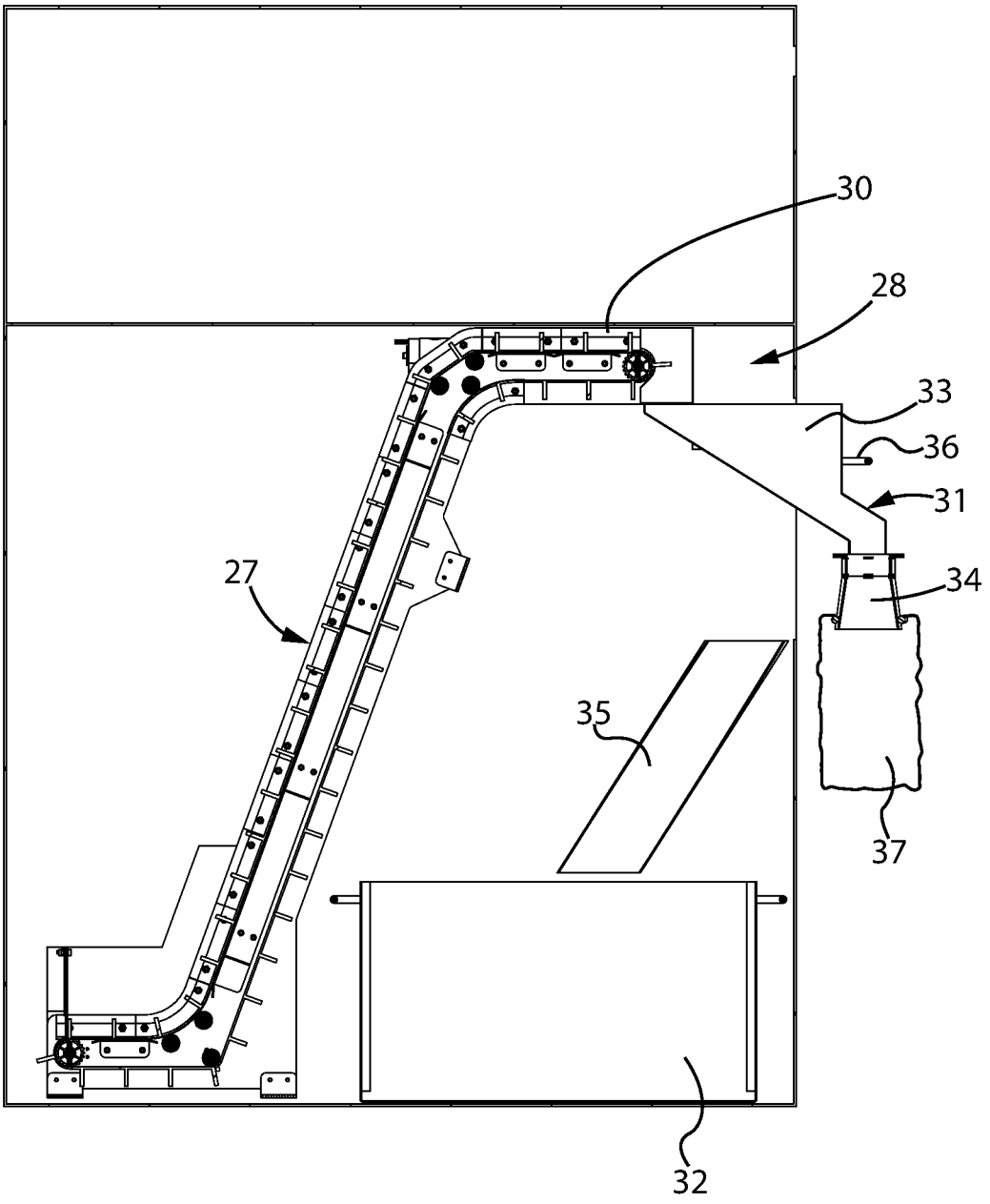
FIG. 6 represents a view like that of FIG. 5, in a second operative condition according to the disclosure.
Figure 10:
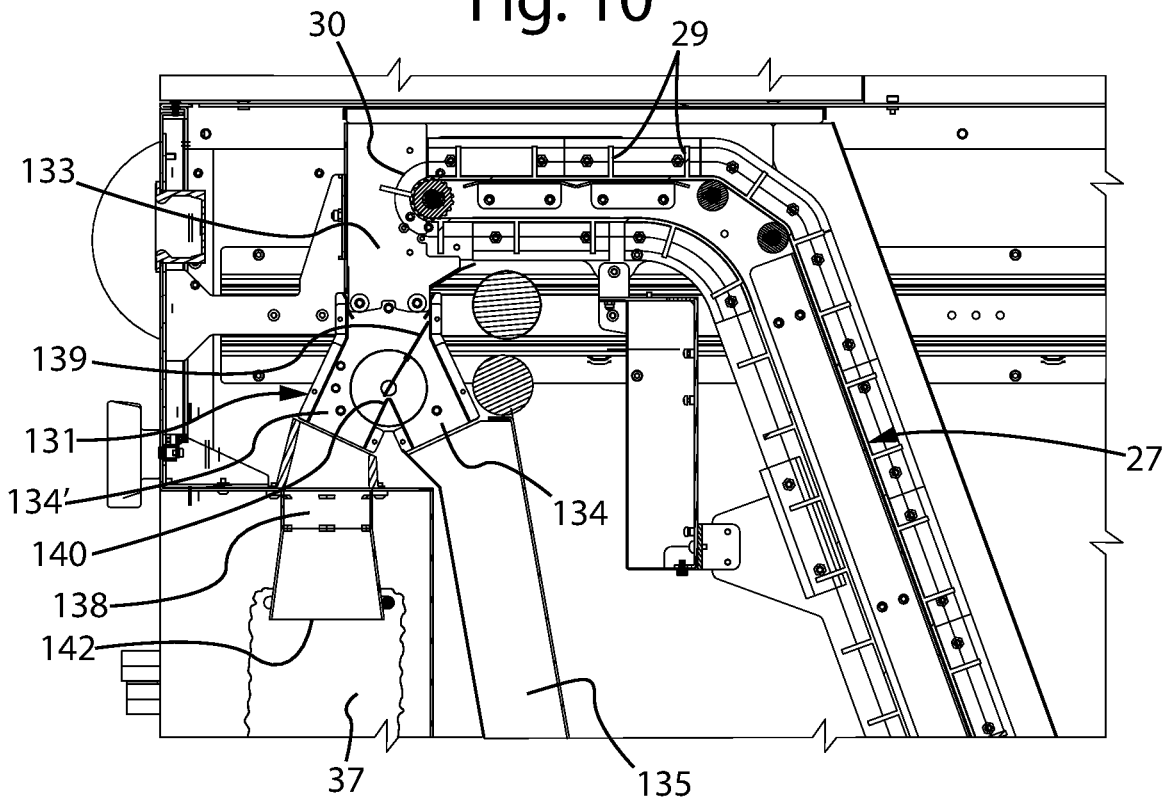
FIG. 10 represents a view like that of FIG. 9, with the coin path selector in the second operative condition according to the disclosure.

At this point, if the selector 31 is in the advanced position of FIG. 6 (or the selector 131 in the closed position of the conduit 135 like in FIG. 10), the coins can be introduced into a bag 37 and consequently accounted for. If, on the contrary, the selector 31 is in the retracted position of FIG. 5 (or the selector 131 in the closed position of the conduit 138 like in FIG. 9), the coins flow, through the conduit 35, into the collection container 32 housed inside the machine.

In particular, in this step there can be two situations.

If only one internal hopper 15 is full, a single denomination of coins (corresponding to the hopper concerned) will be managed by the conveying means 18, 23, 27 and the operator can choose whether to make them flow into the internal collection container 32 (where, normally, they will end up mixed with coins of other denominations contained in it), or dispense them externally into a bag 37 dedicated only to that denomination. In the first case, the internal collection container 32 (also due to the fact that it is normally of considerable size and weight) must be eventually managed by authorized workers (CIT), by emptying and accounting of the content, or by its removal and replacement with an empty container. In the second case, it is possible to form a homogeneous reserve of coins of the same denomination, available for possible needs directly with the manager of the machine.

If two or more internal hoppers 15 are full, the conveying means 18, 23, 27 will manage different denominations of coins simultaneously and, in any case, the operator can choose whether to make them flow into the internal collection container 32 (with successive intervention of the CIT, as explained above), or dispense them externally into a bag 37 that analogously will contain a reserve of coins of various denominations, but that can however be managed more easily directly by the operator, without intervention of the CIT.

In the machine according to the disclosure an "almost full" level can advantageously be set, for each of the internal hoppers 15, so as to signal in advance, before a new depositing operation starts, whether one or more hoppers may have a high probability of filling up and thus not being able to receive new coins. In this case, once the aforementioned "almost full" condition is reached, the hopper involved can be preventively partially emptied, so as to increase the current filling capacity thereof, and the operator can choose whether to make the coins unloaded from the hopper flow into the internal collection container 32 together with coins of other denominations, or whether to dispense them into a respective bag 37 (possibly repeating this operation for each denomination involved) so as to directly have, as explained above, reserves of coins of various denominations in place without the need for the intervention of workers specialized in the management and transportation of valuables.

A further possibility of use of the machine according to the disclosure can be identified in the withdrawal step.

Indeed, in addition to the classic withdrawal by the cashier by means of filling the till, a double further possibility of withdrawal is made available: the first possibility is withdrawal through emptying or removal of the internal collection container 32 (however with the drawbacks described above, linked to the need for intervention by the workers specialized in the management and transportation of valuables), whereas the second possibility is given by the possibility of withdrawing coins (advantageously in homogeneous denominations) through the bags 37 arranged in ergonomically optimal position outside the machine. This second possibility is particularly advantageous when a cashier during his/her shift needs (due to particularly busy commercial activity) to restore the amount of only some denominations of coins in his/her till: in this case, the withdrawal of the required number of coins of one or more denominations can be carried out by means of dispensing in corresponding bags 37 by the respective internal hoppers 15 and these bags can then be easily used by the cashier to fill the respective spaces of his/her till.

Of course, the description given above of an embodiment applying the innovative principles of the present disclosure is given as an example of such innovative principles and therefore must not be taken as a limitation of the scope of protection claimed here.

For example, the machine can be provided with various fittings and functionalities normally used in the field, like for example the possibility of accepting, in suitable dedicated spaces, paper documents, such as envelopes and similar.

The invention claimed is:

1. Machine for depositing and dispensing coins, comprising:

(a) a first portion containing devices for reception of the deposited coins and for recognition and sorting of the coins based on the denomination thereof, (b) a second portion containing a plurality of internal hoppers configured to selectively contain the coins sorted by denomination and adapted to form a reserve for dispensing predetermined amounts and compositions of coins, and (c) a third portion containing coin processing means for processing the coins in the dispensing step, ($c_1$) said third portion being arranged at a lower height with respect to the second portion, ($c_2$) a seat being present in said third portion for the temporary housing of a till used by a user, configured to be filled with predetermined compositions of coins of the various denominations coming from the internal hoppers, the machine also comprising:

(d) coin conveying means adapted ($d_1$) to receive, at the seat for the temporary housing of a till, at a height equal to or lower than the seat, coins coming from the internal hoppers or from the coin recognition and sorting devices, and ($d_2$) to convey them to a higher zone of the machine, (e) a coin path selector is arranged at the end of said coin conveying means to said higher zone of the machine, the coin path selector being movable between ($e_1$) a first position wherein it enables the conveyance of the coins into an internal collection container and ($e_2$) a second position wherein it enables the dispensing of the coins outside the machine.

2. Machine according to claim 1, wherein the coin path selector is formed of an upper portion, adapted to collect the coins coming from said coin conveying means, and of two lower collector portions, configured respectively to convey the coins towards said internal collection container or towards the outside of the machine.

3. Machine according to claim 1, wherein the coin path selector is arranged between the upper end of said coin conveying means to said higher zone of the machine and two conduits arranged below the selector and directed respectively towards said internal collection container and towards the outside of the machine.

4. Machine according to claim 2, wherein a first of said lower collector portions of the coin path selector is arranged at the mouth of the conduit directed to the internal collection container and the second of said lower collector portions of the selector is arranged at the mouth of the conduit directed towards the outside of the machine.

5. Machine according to claim 2, wherein the selector is provided with a diverting fin that is movable between a first position closing the lower collector portion configured for conveying the coins towards the outside of the machine and opening the lower collector portion configured for conveying the coins towards the internal collection container and a second position closing the lower collector portion configured for conveying the coins towards the internal collection container and opening the lower collector portion configured for conveying the coins towards the outside of the machine.

6. Machine according to claim 5, wherein the diverting fin is hinged, with one end thereof, at the vertex of the forking between the two lower collector portions.

7. Machine according to claim 3, wherein the conduit directed towards the outside of the machine has an end that faces outside of the machine and that is adapted to provide support and fastening for a collection bag of the coins dispensed outside the machine.

8. Machine according to claim 7, wherein said end of the conduit directed towards the outside of the machine faces into a niche contained inside the external shape of the machine.

9. Machine according to claim 1, wherein the coin path selector is formed of an upper funnel portion, adapted to collect the coins coming from said coin conveying means, and of a lower collector portion configured to dispensing the coins.

10. Machine according to claim 9, wherein the first position of the movable selector is a retracted position towards the inside of the machine, wherein the collector portion is at the mouth of a conduit directed towards said internal collection container, and the second position of the movable selector is an advanced position towards the outside of the machine, wherein the collector portion faces the outside of the machine.

11. Machine according to claim 9, wherein the upper funnel portion has an inlet opening with suitable size to collect the coins coming from said coin conveying means both when the selector is in the first position, and when it is in the second position.

12. Machine according to claim 1, wherein the coin path selector is provided with a handle for manually maneuvering it between the first position and the second position.

13. Machine according to claim 9, wherein the collector portion is adapted to provide support and fastening for a collection bag of the coins dispensed outside the machine.

14. Machine according to claim 1, wherein the coin conveying means to said higher zone of the machine comprise devices for lateral transfer of the coins from the zone of the seat for the temporary housing of a till to a side portion of the machine and an elevator for the successive transfer of the coins up to said higher zone of the machine.

15. Machine according to claim 14, wherein said coin lateral transfer devices comprise a first conveyor adapted to receive coins coming from the internal hoppers or from the coin recognition and sorting devices on a loading zone thereof, alternatively to the dispensing into the till, and to convey them in a first direction from its loading zone to an unloading end and a second conveyor adapted to receive, at the unloading end of the first conveyor, the coins on a loading zone thereof and to convey them in a second direction up to an unloading end thereof at the elevator.

16. Machine according to claim 15, wherein said first and second conveyor are motorized endless conveyor belts.

17. Machine according to claim 14, wherein the elevator is formed of a motorized endless conveyor belt, provided with blades for supporting the coins during the transfer thereof towards said higher zone of the machine.

18. Method for using a machine for depositing and dispensing coins according to claim 1, wherein coins coming from the internal hoppers or from the coin recognition and sorting devices are conveyed, by means of said coin conveying means adapted to receive the coins at the seat for the temporary housing of a till, up to a coin path selector in said higher zone of the machine, wherein the coin path selector is alternatively positioned either in a first position adapted to convey the coins into said internal collection container or in a second position adapted to dispense the coins outside the machine.

19. Method according to claim 18, wherein the coin path selector, when it is in said second position, dispenses the coins into a bag outside the machine.

20. Method according to claim 18, wherein the coins that reach said coin conveying means are caused to selectively come from one of the internal hoppers as a function of the denomination of the coins to be conveyed to the path selector.

21. Method according to claim 20, wherein the coins that reach said coin conveying means are caused to come from an internal hopper when a predetermined filling level of said internal hopper is reached.

22. Method according to claim 18, wherein the conveying of the coins to the path selector is carried out during the coin depositing step.

* * * * *